US008931558B1

(12) United States Patent
Harper

(10) Patent No.: US 8,931,558 B1
(45) Date of Patent: Jan. 13, 2015

(54) FLOW LINE CLEANOUT DEVICE

(75) Inventor: Tom M. Harper, Lafayette, LA (US)

(73) Assignee: Full Flow Technologies, LLC, Lafayette, LA (US)

( * ) Notice: Subject to any disclaimer, the term of this patent is extended or adjusted under 35 U.S.C. 154(b) by 240 days.

(21) Appl. No.: 13/427,546

(22) Filed: Mar. 22, 2012

(51) Int. Cl.
*E21B 37/00* (2006.01)
*B08B 9/051* (2006.01)

(52) U.S. Cl.
USPC ... 166/311; 166/223; 15/104.061; 15/104.12; 134/168 C; 134/196 C

(58) Field of Classification Search
CPC ..... E21B 37/00; E21B 21/00
USPC ..... 166/311, 223, 77.2, 177.7; 15/104.061, 15/104.12, 104.05; 134/166 R, 167 R, 134/168 C, 167 C, 169 R, 198, 169 C
See application file for complete search history.

(56) References Cited

U.S. PATENT DOCUMENTS 2,155,205 A * 4/1939 Rodgers ..... 15/104.12
2,232,018 A * 2/1941 Wright ..... 15/104.12
2,692,752 A * 10/1954 Heiss ..... 173/59
3,804,557 A * 4/1974 Bentley ..... 417/402
4,011,100 A * 3/1977 Ross ..... 134/8
4,037,661 A * 7/1977 Ford ..... 166/311
4,625,799 A * 12/1986 McCormick et al. ..... 166/223
4,705,107 A * 11/1987 Council et al. ..... 166/170
4,919,204 A * 4/1990 Baker et al. ..... 166/223
5,090,079 A * 2/1992 Allison et al. ..... 15/104.31
5,158,140 A * 10/1992 Ferry ..... 166/312
5,180,012 A 1/1993 Crawford
5,244,505 A * 9/1993 Allison et al. ..... 134/22.11
5,280,825 A * 1/1994 Cholet ..... 166/311
5,402,855 A 4/1995 Gondouin
5,447,200 A * 9/1995 Dedora et al. ..... 166/311
5,474,097 A * 12/1995 Lowe et al. ..... 134/104.4
6,070,285 A * 6/2000 Geppert ..... 15/104.061
6,122,791 A 9/2000 Baugh et al.
6,173,771 B1 * 1/2001 Eslinger et al. ..... 166/173
6,397,864 B1 6/2002 Johnson
6,490,748 B1 * 12/2002 O'Neill ..... 15/104.09
6,651,744 B1 11/2003 Crawford
6,820,653 B1 * 11/2004 Schempf et al. ..... 138/98
6,840,315 B2 * 1/2005 Jarchau et al. ..... 166/223
7,025,142 B2 * 4/2006 Crawford ..... 166/311
7,121,343 B2 * 10/2006 Telfer ..... 166/311
7,174,975 B2 2/2007 Krueger et al.
7,296,627 B2 * 11/2007 Dyer ..... 166/304
7,314,083 B1 * 1/2008 Martini ..... 166/311
7,377,283 B2 * 5/2008 Walker et al. ..... 134/22.1
7,406,738 B2 8/2008 Kinnari et al.
7,497,261 B2 * 3/2009 Dyer ..... 166/304
7,699,110 B2 * 4/2010 Anderson et al. ..... 166/368
7,757,781 B2 * 7/2010 Hay et al. ..... 175/26
8,133,328 B2 * 3/2012 Delaney et al. ..... 134/167 R (Continued)

*Primary Examiner* — Jennifer H Gay

(57) ABSTRACT

A flow line cleanout device for a coiled tubing head of a coiled tubing string is comprised of a hydraulic vane motor assembly having a rotor configured for attachment to and rotation of a work tool such as a fluid ejecting nozzle to be inserted into a flow line. Seals around the device seal the flow line so that fluid pressure behind the coiled tubing head force fluid through the hydraulic vane motor assembly to rotate the rotor and the attached nozzle in response to pressure changes created by check valves. Jets of fluid from the rotating nozzle serve to wash and remove blockages in the flow line and facilitate the insertion and advancement of the coiled tubing string.

33 Claims, 15 Drawing Sheets

(56) References Cited

U.S. PATENT DOCUMENTS

| | | | | |
|---|---|---|---|---|
| 8,408,307 | B2 * | 4/2013 | Telfer | 166/311 |
| 8,479,821 | B2 * | 7/2013 | Crawford et al. | 166/311 |
| 8,528,630 | B2 * | 9/2013 | Tunget | 166/55.8 |
| 2001/0043838 | A1 | 11/2001 | Baugh et al. | |
| 2004/0118565 | A1 * | 6/2004 | Crawford | 166/312 |
| 2004/0194809 | A1 * | 10/2004 | Crawford et al. | 134/22.12 |
| 2005/0098349 | A1 | 5/2005 | Krueger et al. | |
| 2006/0219409 | A1 * | 10/2006 | Dyer | 166/304 |
| 2008/0047712 | A1 * | 2/2008 | Dyer | 166/304 |
| 2008/0050180 | A1 | 2/2008 | Baugh | |
| 2008/0073077 | A1 | 3/2008 | Tunc et al. | |
| 2009/0025927 | A1 * | 1/2009 | Telfer | 166/174 |
| 2009/0095528 | A1 * | 4/2009 | Hay et al. | 175/26 |
| 2009/0126933 | A1 * | 5/2009 | Telfer | 166/301 |
| 2011/0000668 | A1 * | 1/2011 | Tunget | 166/285 |
| 2011/0146998 | A1 * | 6/2011 | Tunget | 166/311 |
| 2011/0214872 | A1 * | 9/2011 | Crawford et al. | 166/311 |
| 2011/0253376 | A1 * | 10/2011 | Krpec | 166/311 |
| 2012/0234548 | A1 * | 9/2012 | Dyer | 166/311 |
| 2013/0056216 | A1 * | 3/2013 | He | 166/311 |
| 2014/0053874 | A1 * | 2/2014 | Mackenzie et al. | 134/22.12 |

* cited by examiner

FLOW LINE CLEANOUT DEVICE

FIELD OF INVENTION

The present invention relates to an apparatus to be used in inserting and removing a coiled tubing string from a flow line such as a pipe string in a well bore or pipeline. More particularly, the present invention relates to an improved coiled tubing head attached to the leading end of a coiled tubing string. The coiled tubing head is comprised on a hydraulic vane motor for rotating a work tool such as a nozzle for injecting a fluid stream into the flow line for clearing the flow line and advancing the coiled tubing string. The coiled tubing head with the hydraulic motor vane serves to assist the advancement of the coiled tubing string into a flow line.

BACKGROUND

In the oil and gas industry, wells are drilled into the earth to gain access to the hydrocarbon bearing zones. Once these wells are drilled, they are attached to flow lines that allow these hydrocarbons to be transported to facilities that would further refine these hydrocarbons for useful sale. These flow lines can be very long, sometimes in excess of ten miles. In addition to the hydrocarbons, contaminants also flow through the flow lines. From time to time these flow lines can become blocked, sometimes from unwanted contaminants such as sand, and other times with hydrates or paraffin produced by the flow of hydrocarbons.

Conventional techniques to remove these blockages include the use of chemicals to dissolve the blockage, hydraulic pressure to move the blockage, and mechanical methods such as by advancing a continuous length of hollow coiled tubing with attached tubing head into the flow line. When coiled tubing is utilized, as a section of the continuous tubing is pushed into the flow line, fluid is pumped through the tubing head to wash the flow line blockage away and return the contaminants to the surface for disposal. The distance of coiled tubing travel in a flow line is typically limited due to frictional forces that halt the forward progress of the coiled tubing. Sometimes coiled tubing progress is halted after it is advanced as little as 5,000 feet depending on the flow line configuration. To increase the distance that the coiled tubing can travel in these flow lines and further improve the washing or cleaning of the line, an improved coiled tubing head and technique is required.

SUMMARY OF THE INVENTION

The improved flow line cleanout device, referred to herein as the coiled tubing head, is comprised of a hydraulic vane motor having a vane section and hollow motor rotor connected to a work tool such as the nozzle depicted herein. The vane motor is positioned within an outer motor main housing that is intended to be placed at the leading end of a coiled tubing string for insertion into a flow line, such as into a pipe string in a well bore or into a pipeline. Ports are provided at the rear of the motor main housing and the vane motor itself. Flexible seals provided around the main housing serve to seal the annulus that is created between the flow line and the main housing in order to maintain fluid pressure in that annulus.

When fluid is pumped on the annulus or down the flow line, the fluid is stopped by the flexible seals forcing the fluid through ports at the rear of the motor housing and into the vane section of the vane motor to rotate the motor rotor. A set of ports, each having a check valve, are provided in the high pressure side of the vane motor to limit the amount of fluid that will travel through the vane section of the vane motor by diverting a portion of the fluid around the vane section of the vane motor to the hollow motor rotor thereby reducing the rotational speed of the motor rotor. The torque and operating pressure of the vane motor may be set as desired by the check valves by allowing a large portion of the fluid to by-pass the vane section of the vane motor. Regardless of the fluid path, either through or around the vane section of the vane motor, all fluid will pass through the nozzle to facilitate the removal of the blockages.

The hydraulic vane motor is encased in an outer housing to prevent the parts of the motor to escape into flow line itself in the event of a catastrophic failure of the motor. Although a motor failure would prevent rotation of the wash nozzle, it would not prevent fluid from flowing through the motor and out to the wash nozzle to allow washing to continue.

The rotating rotor shaft of the hydraulic vane motor and the nozzle are provided with a through bore that are in communication with the coiled tubing string. These through bores allow debris and contaminated fluid from the flow line to be routed through the nozzle and the rotor shaft and up the attached coiled tubing string for removal at the surface or entrance end of the flow line.

The fluid circulating through the vane motor creates rotation and torque on the vane motor rotor, a corresponding rotation of the nozzle, and a subsequent discharge of fluid from the fluid jets of the nozzle. These fluid jets create a rotating wash stream in a 360° rotation around the interior of the flow line to wash away any flow line debris that may be encountered and to breakup any blockages in the flow line.

The coil tubing head described herein is attached to coiled tubing string by a non-rotating swivel. The non-rotating swivel is utilized so that torque created by the hydraulic vane motor will not cause the motor to turn in response to such torque and still allow the motor assembly to pivot or negotiate bends in the flow line as small as five times the diameter of the flow line itself.

While it is thought that the coiled tubing head with the hydraulic motor assembly described herein will be more readily utilized in advance of a coiled tubing string, the hydraulic motor assembly may adapted for rotating a work tool in advance of any type of pipe string such as a drill pipe string. Though several types of hydraulic motors exist in the oil and gas industry to facilitate the drilling of wells, including, progressive cavity, vane and turbine motors, these motors have not heretofore been adapted for use in a coiled tubing head as described herein due to, among other perceived disadvantages, their size and length.

Figure 1:
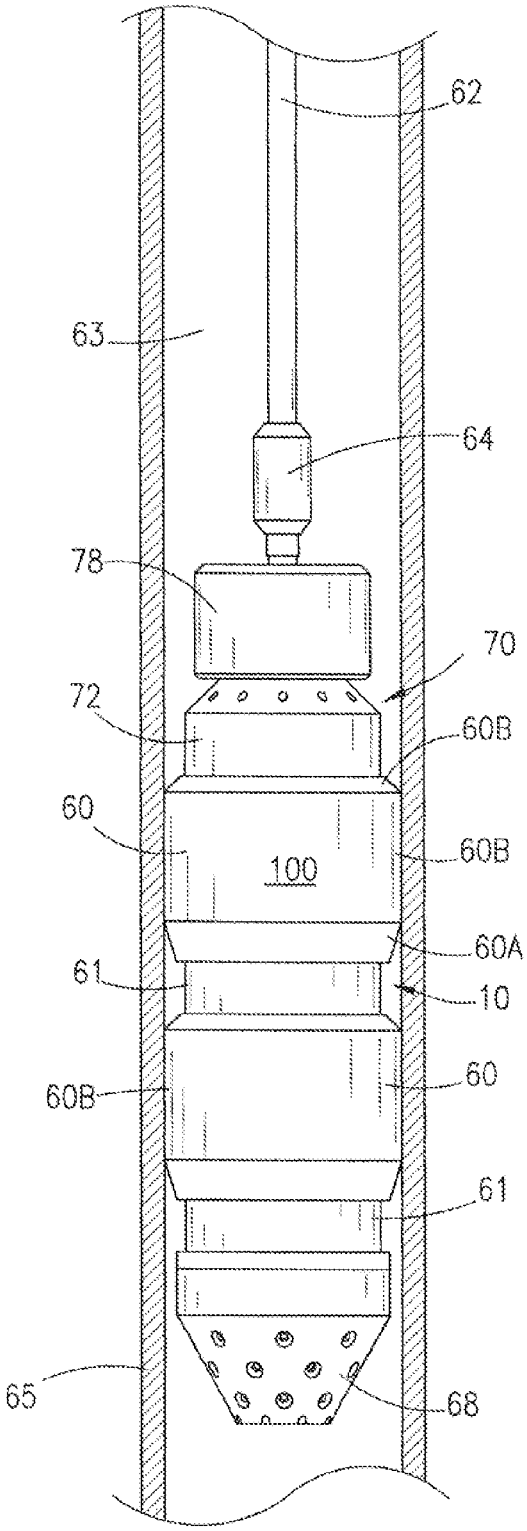
FIG. 1 is a longitudinal cross-section of a flow line with the proposed coiled tubing head to attached to a string of coiled tubing.

In the drawings, certain features that are well established in the art and do not bear upon points of novelty have been omitted in the interest of descriptive clarity. Such omitted features may include threaded junctures, weld lines, sealing elements, pins and brazed junctures.

DESCRIPTION OF EMBODIMENT

Referring now to the drawings and more particularly to FIG. 1, there is shown a longitudinal cross-section of a flow line (65) with the proposed coiled tubing head (100) attached to a string of coiled tubing (62). The coiled tubing head (100) is comprised of a hydraulic vane motor assembly (10) having a cylindrical main housing (12) containing a rotatable shaft (20) in cooperation with a work tool such as a nozzle (68). Around the periphery of the main housing (12) of the hydraulic motor assembly (10) are a series of cylindrical, flexible seals (60) separated by seal spacers (61). The coiled tubing head (100) is attached to the coiled tubing string (62) by at least one knuckle joint (64) and release mechanism. Such knuckle joints and release mechanisms are well known in the industry.

The flexible seals (60) around the main housing (12) serve to seal the annulus (63) that is created between the flow line (65) and the coiled tubing head (100) and coiled tubing string (62) in order to maintain fluid pressure in the annulus (63). The seals (60) are comprised of a cylindrical metal sleeve (60A) with a reinforced, resilient cover (60B) made of polyurethane or other resilient polymer material. However, other suitable sealing means may also be utilized.

Figure 2:
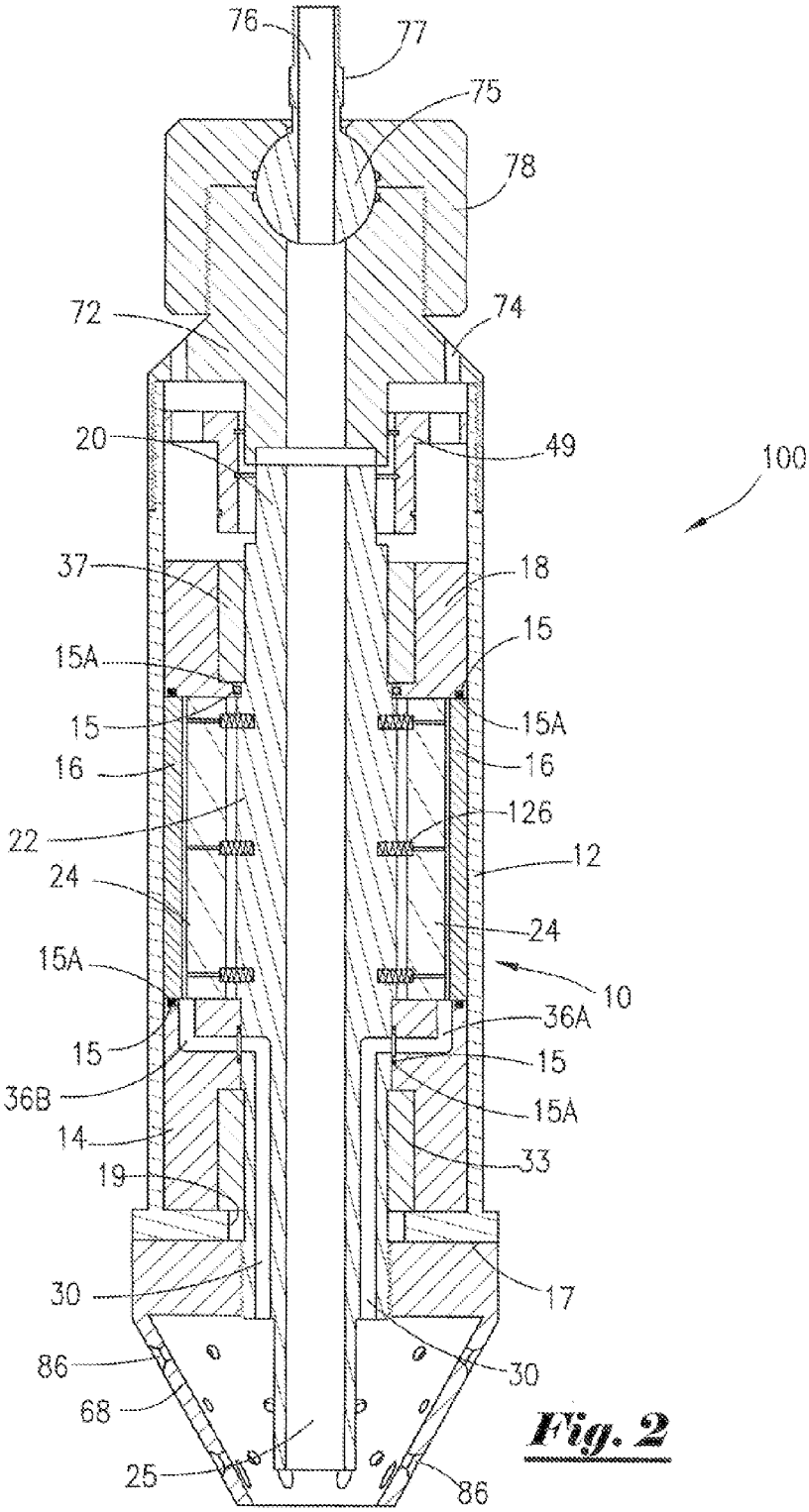
FIG. 2 is a longitudinal cross-section view of the hydraulic motor assembly of the coiled tubing head shown in FIG. 1.
Figure 3:
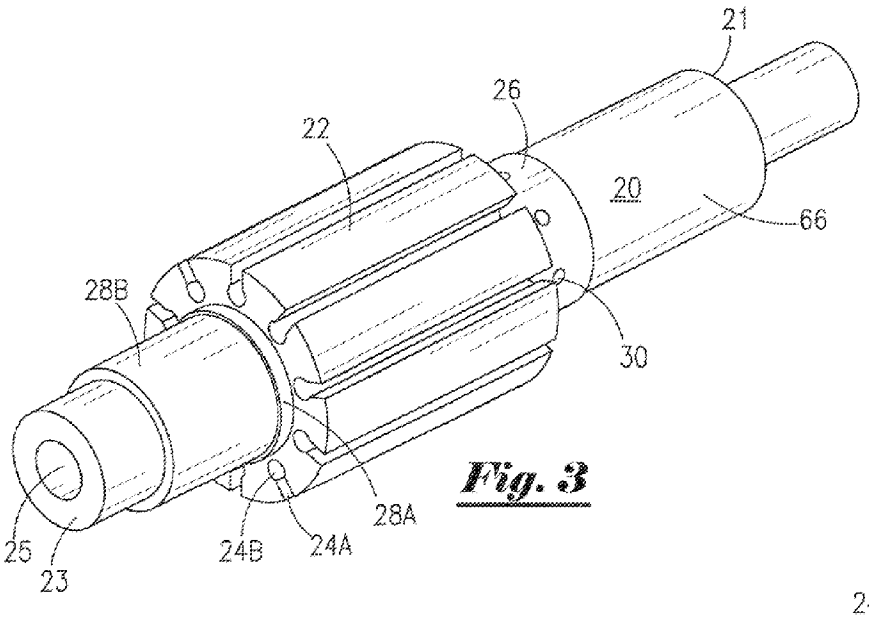
FIG. 3 is a rear perspective view of the rotor shaft of the hydraulic motor assembly of the coiled tubing head shown in FIG. 1.
Figure 4:
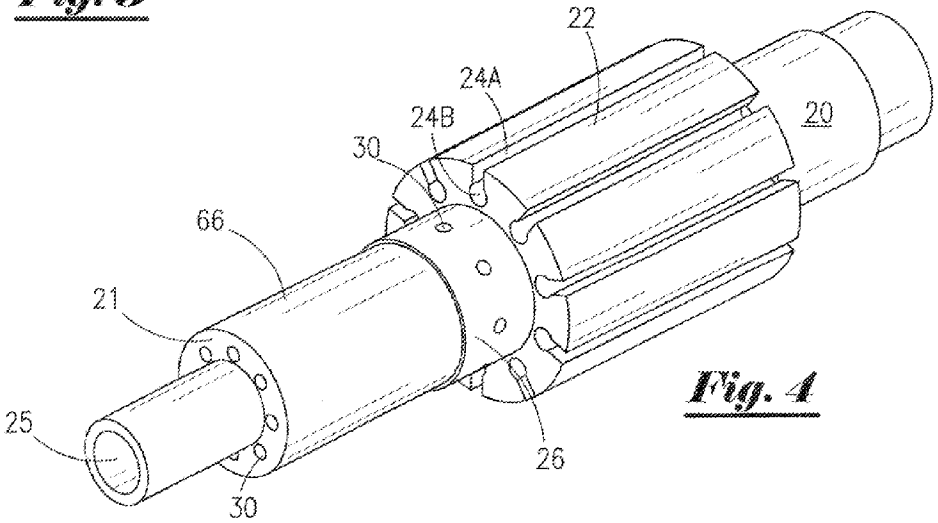
FIG. 4 is a front perspective view of the rotor shaft of the hydraulic motor assembly of the coiled tubing head shown in FIG. 1.
Figure 5:
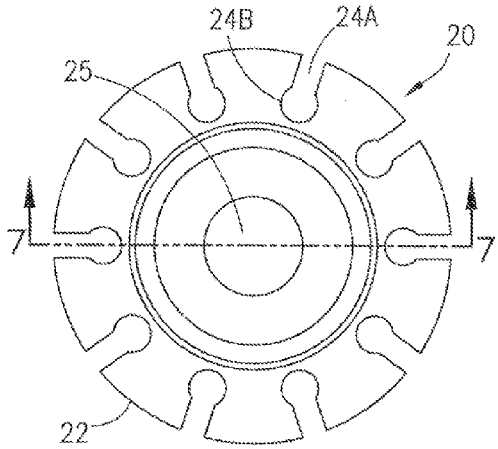
FIG. 5 is a rear elevation view of the rotor shaft of the hydraulic motor assembly of the coiled tubing head shown in FIG. 1.
Figure 7:
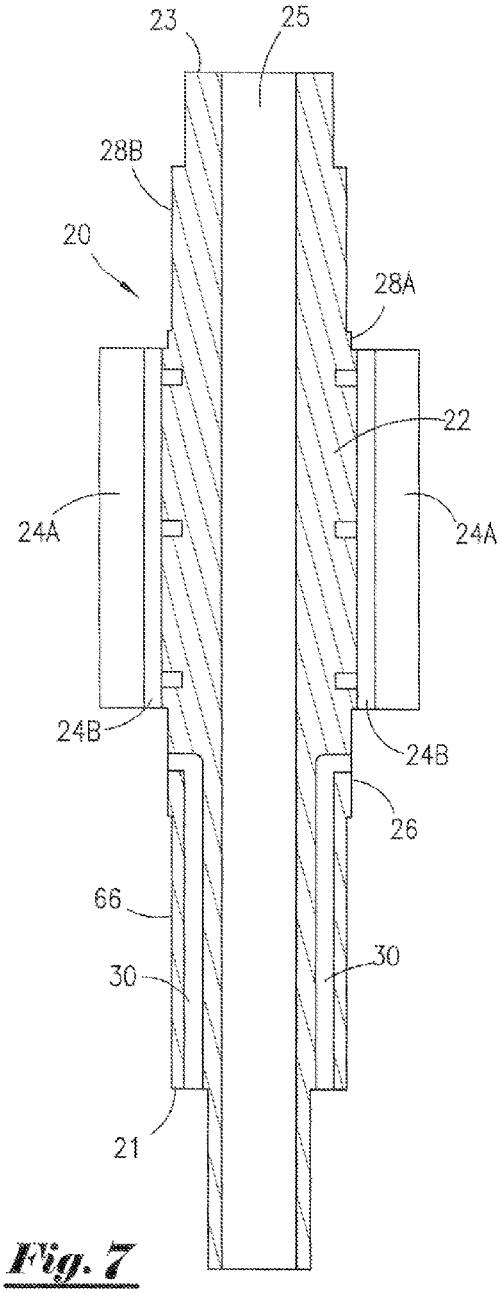
FIG. 7 is a longitudinal cross section view of the rotor shaft of the hydraulic motor assembly of the coiled tubing head shown in FIG. 1.
Figure 6:
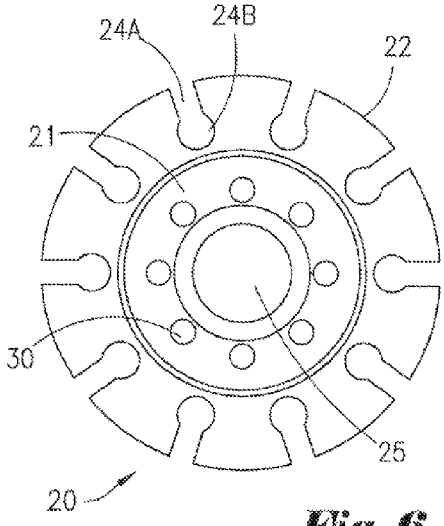
FIG. 6 is a front elevation view of the rotor shaft of the hydraulic motor assembly of the coiled tubing head shown in FIG. 1.
Figure 8:
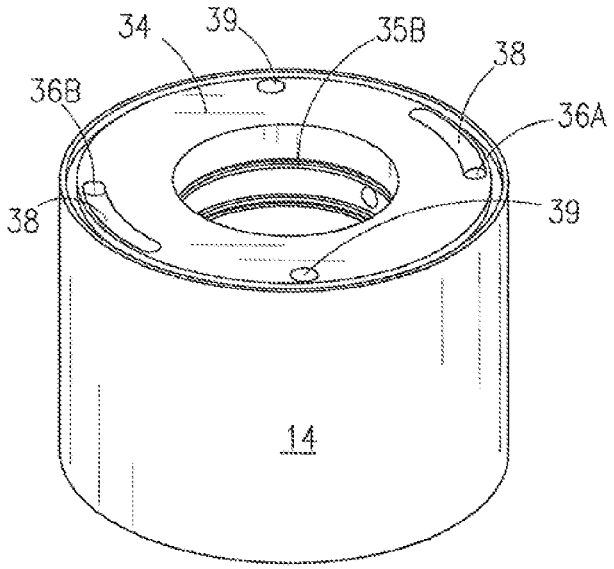
FIG. 8 is a perspective view of the front bearing housing of the hydraulic motor assembly of the coiled tubing head shown in FIG. 1.
Figure 9:
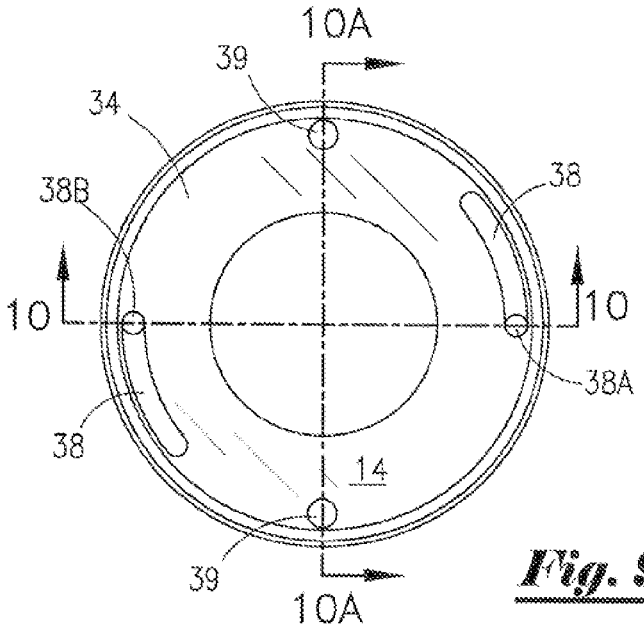
FIG. 9 is a rear elevation view of the front bearing housing of the hydraulic motor assembly of the coiled tubing head shown in FIG. 1.

Referring now to FIG. 2, there is shown the components of the vane motor assembly (10). The vane motor assembly (10) is comprised of a cylindrical main housing (12) which contains a cylindrical front bearing housing (14) that retains a front bearing assembly (33), a cylindrical vane housing (16), and a rear bearing housing (18) that retains a rear bearing assembly (37). A front housing stop (17) having a rotor bore or opening (19) is attached to the main housing (12).

A hollow motor rotor shaft (20) extends longitudinally through the front hearing housing (14) and front bearing assembly (33), the vane housing (16), the rear bearing housing (18) and rear bearing assembly (37), and through the rotor opening (19) at the front housing stop (17). The motor rotor shaft (20), the front bearing housing (14), the vane housing (16), the rear bearing housing (18), and the motor rotor shaft (20) are retained within the main housing (12) by the front housing stop (17) and a removable rear stop assembly (49).

Corresponding pin and bore connections (not shown) are used to mate the vane housing (16) together with the front bearing housing (14) and the rear bearing housing (18). The pin and bore connections maintain the relative positions of vane housing (16), the front bearing housing (14), and the rear bearing housing (18) when these components are inserted into the main housing (12). Ring grooves (15) are provided for corresponding O-ring gaskets (15A) or other means for sealing the interfaces of the vane housing (16), front bearing housing (14) and rear bearing housing (18) within the interior of the main housing (12).

As shown in FIG. 2 and in more detail in FIG. 3-FIG. 7, the motor rotor shaft (20) has a front face (21), a rear face (23), a rotor shaft through bore (25), and a raised vane section (22) that extends around the periphery of the rotor shaft (20). Positioned longitudinally along the rotor shaft (20) from the front face (21) to the rear face (23) is a front rotor shoulder (26), a first rear rotor shoulder (28A) and a second rear rotor shoulder (28B). The nozzle (68) is configured for attachment around the forward end (66) of the rotor shaft (20) by mounting threads or other attachment means. Fluid ports (30) are distributed around the through bore (25) of the motor rotor shaft (20) to extend from the front face (21) of the motor rotor shaft (20) to exit the radially from the rotor shaft (20) to the front bearing housing (14). The vane section (22) of the rotor shaft (20) is machined to create a plurality of radially extending vane spaces (24A) enhanced by a longitudinally extending groove (24B). These vane spaces (24A) are configured to retain a spring biased vane (24) during operation of the motor assembly (10).

FIGS. 8-10A show the front bearing housing (14). The front bearing housing (14) has a front end (31) and a rear end (32). The front bearing housing (14) has a central bore opening (35) that is stepped so as to provide a front bore diameter surface (35A) and a rear bore diameter surface (35B). The front bore diameter surface (35A) is configured to retain the front roller bearing assembly (33) as shown in FIG. 2. Inlet fluid ports (36A) and outlet fluid ports (36B) are positioned in a surface grove (38) and extend from the rear end (32) of the front bearing housing (14). The fluid ports (36A) and (36B) are configured to extend radially inward to the front bore opening (35B) to alignment with the fluid ports (30) of the motor rotor shaft (20) as shown in FIG. 2.

Ring grooves (15) are provided on the bearing housing (14) for corresponding O-ring gaskets (15A) to seal the area around the interface between the fluid ports (36A) and (36B) and the fluid ports (30) of the motor rotor shaft (20). Check valve bores (39) extend from the rear end (32) of the front bearing housing (14) and are configured to extend radially inward to the front bore opening (35B) to alignment with the fluid ports (30) of the motor rotor shaft (20).

Figure 10:
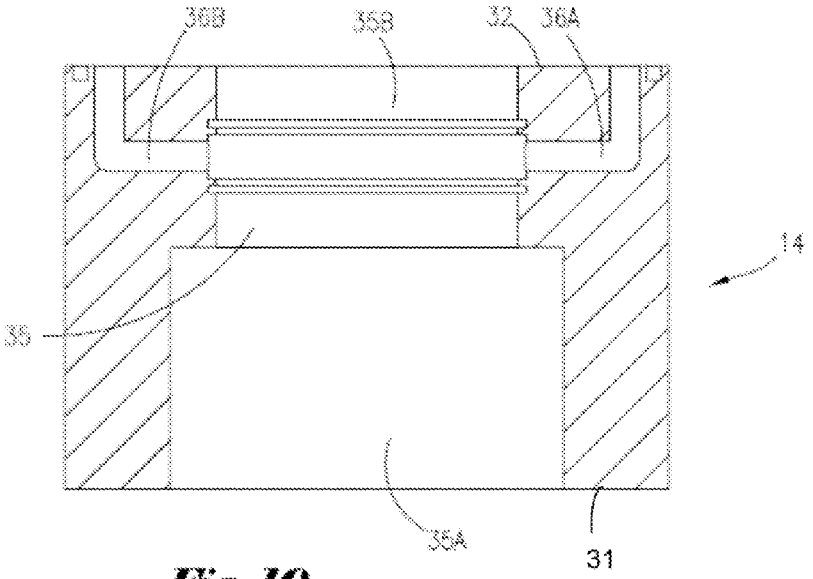
FIG. 10 is a longitudinal cross section view of the front bearing housing of the hydraulic motor assembly of the coiled tubing head shown in FIG. 1.
Figure 10A:
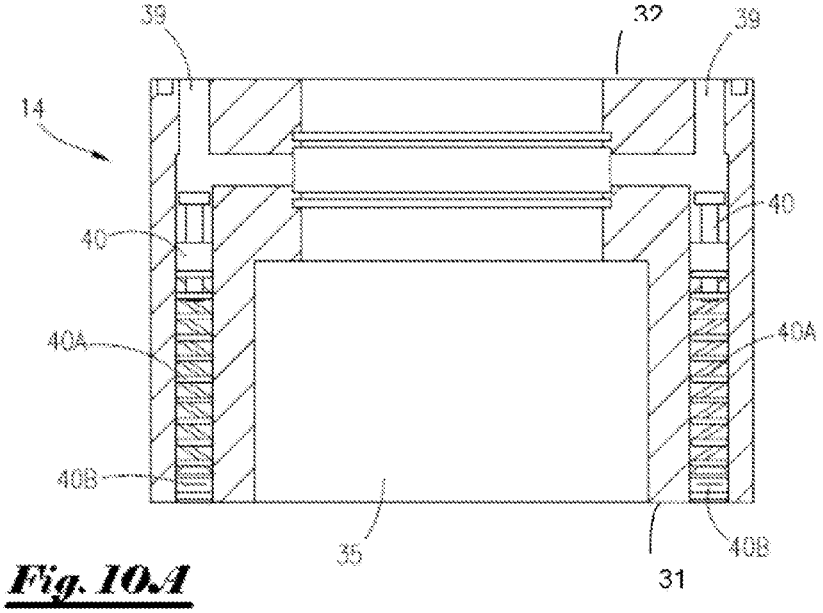

As shown in FIG. 10A, the check valve bores (39) extend from the front end (31) of the front bearing housing (14) to the bore opening (35) and to the to the rear end (32) to retain a check valve (40) and valve compression spring (40A) by means of a valve set screw (40B). The check valve (40) is biased by the spring (40A) to maintain the check valve bore (39) in a desired open or closed condition depending upon fluid pressure. The open condition is shown in FIG. 10A. During startup rotation of the motor rotor (20) as fluid is forced into the vane motor housing, the valve bores (39) are closed by the check valves (40) and springs (40A) of the valves (40) are selected to open the check valve bores (39) in response to predetermined fluid pressures.

The check valve bores (39) and check valves (40) are provided to increase or decrease the fluid pressure in the vane motor assembly (10) as desired by diverting fluid inward to the bore opening (35) and ultimately to the fluid ports (30) of the motor rotor shaft (20) so as to regulate the rotation speed and torque of the rotor shaft (20) during operation. The compression springs (40A) may be selected or changed as desired spring to create a desire check valve closing force.

A threadably removable bearing cover plate (34) is attached to the rear end (32) of the front bearing housing (14). The cover plate (34) has fluid slots (38A) and bores (39A) that correspond, respectively, with the surface grooves (38) and fluid ports (36A) and (36B) and the valve bores (39).

Figure 11:
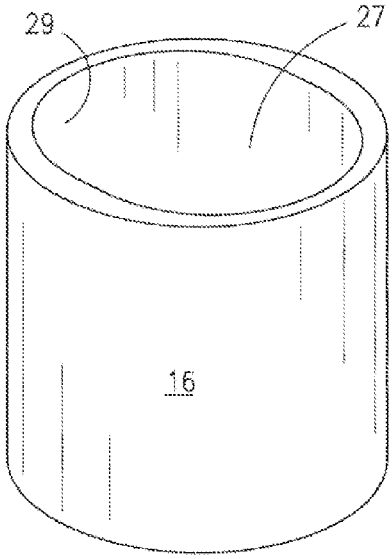
FIG. 11 is a perspective view of the vane housing of the hydraulic motor assembly of the coiled tubing head shown in FIG. 1.
Figure 13:
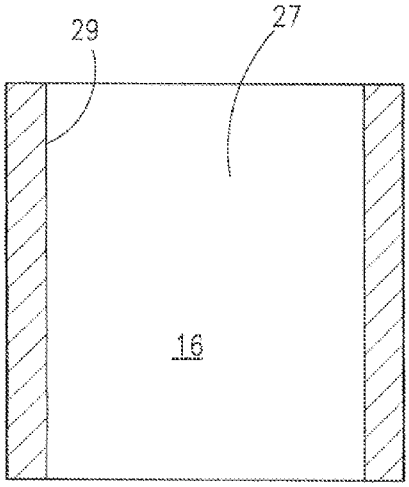
FIG. 13 is a longitudinal cross section view of the vane housing of the hydraulic motor assembly of the coiled tubing head shown in FIG. 1.
Figure 12:
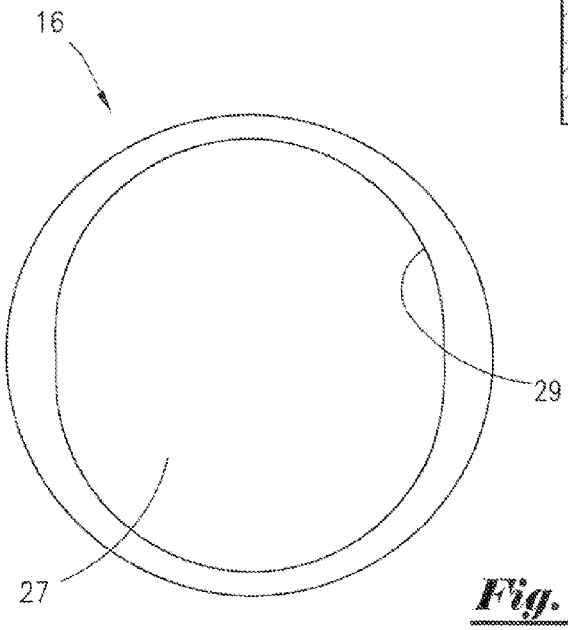
FIG. 12 is a rear elevation view of the vane housing of the hydraulic motor assembly of the coiled tubing head shown in FIG. 1.

FIGS. 11-13 show the configuration of the vane housing (16). The vane housing (16) is comprised of a hollow cylinder configured to enclose the vane section (22) of the motor rotor shaft (20). The vane housing (16) has an interior space (27) defined by an eccentric, multiply curved or cammed interior surface wall (29).

Figure 14:
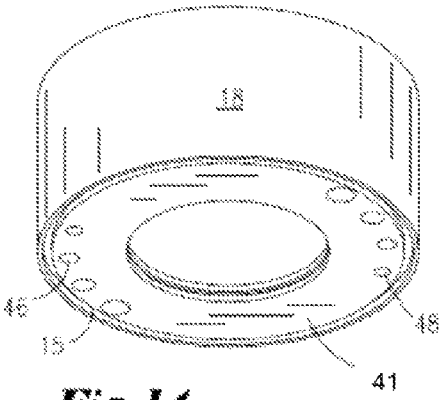
FIG. 14 is a perspective view of the rear bearing housing of the hydraulic motor assembly of the coiled tubing head shown in FIG. 1.
Figure 16:
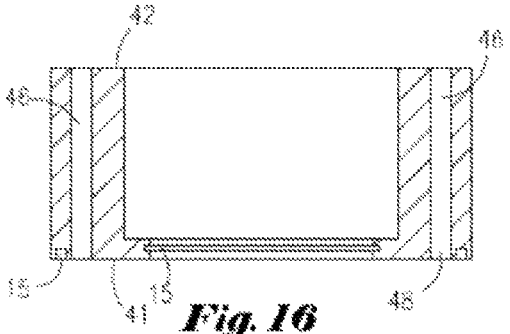
FIG. 16 is a longitudinal cross section view of the rear bearing housing of the hydraulic motor assembly of the coiled tubing head shown in FIG. 1.
Figure 15:
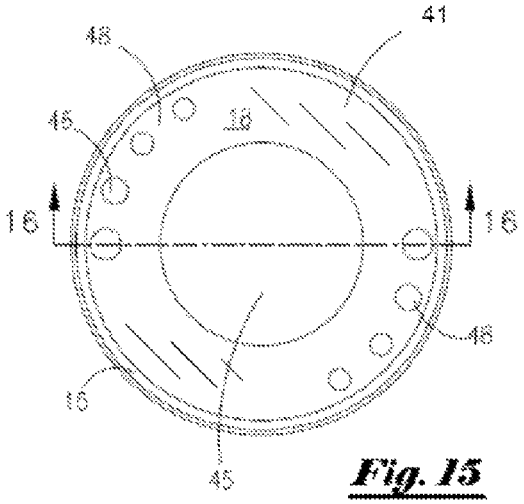
FIG. 15 is a rear elevation view of the rear bearing housing of the hydraulic motor assembly of the coiled tubing head shown in FIG. 1.

The rear bearing housing (18) for retaining the rear bearing assembly (37) is shown in FIGS. 14-16. The rear bearing housing (18) has a front end (41) and a rear end (42). The rear bearing housing (18) has a central bore opening (45) configured to retain the rear bearing assembly (37) as shown in FIG. 2. A first array of graduated fluid ports (46) and a corresponding second array of graduated fluid ports (48) extend through the rear bearing housing (18) from the front end (41) to the rear end (42). The fluid ports (46) and (48) are graduated in size and are positioned opposite each other on the housing (18). Ring grooves (15) for O-ring seals (15A) are provided for a seal around the rotor shaft (20) and the vane housing (16) as shown in FIG. 2.

Figure 17:
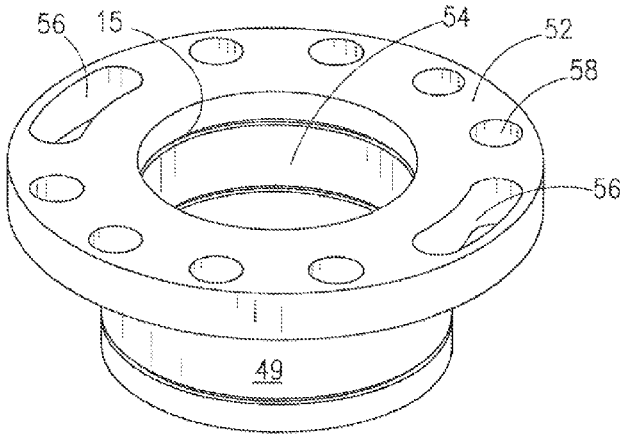
FIG. 17 is a perspective view of the rear stop assembly of the hydraulic motor assembly of the coiled tubing head shown in FIG. 1.
Figure 19:
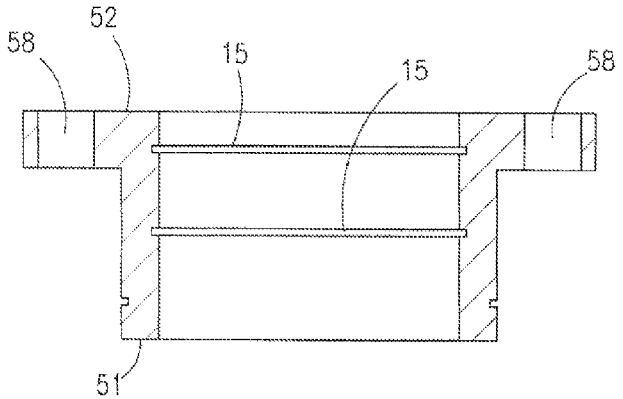
FIG. 19 is a longitudinal cross section view of the rear stop assembly of the hydraulic motor assembly of the coiled tubing head shown in FIG. 1.
Figure 18:
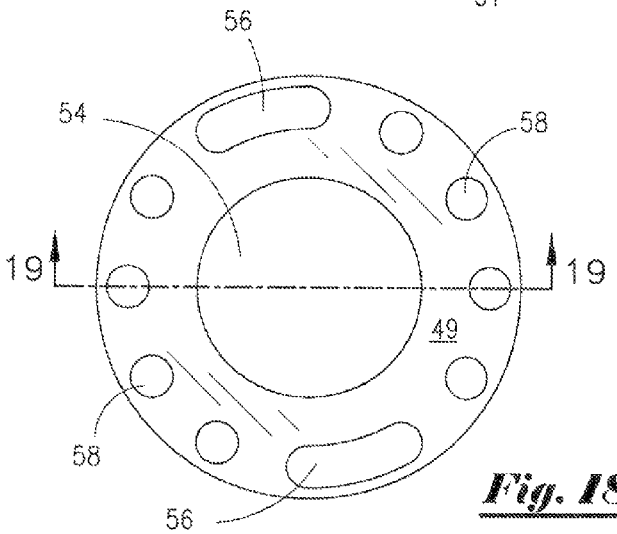
FIG. 18 is a rear elevation view of the rear stop assembly of the hydraulic motor assembly of the coiled tubing head shown in FIG. 1.

FIGS. 17-19 show the rear stop assembly (49) of the main housing (12). The rear stop assembly (49) has a front end (51) and a rear end (52) configured around a central bore opening (54). Fluid slots (56) in the rear end (52) of the rear stop assembly (49) correspond with the array of fluid slots (46) and (48) of the rear bearing housing (18). A plurality of threaded openings (58) for threadably positionable set screws (58A) on the rear end (52) engage with the rear bearing housing (18) for adjustably positioning of the rear stop assembly (49) within the main housing (12) with respect to the rear bearing housing (18). Ring grooves (15) are provided for corresponding O-ring gaskets (15A) to provide a seal around the motor rotor shaft (20).

Figure 21:
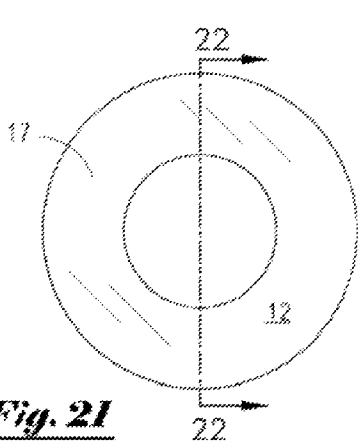
FIG. 21 is a front elevation view of the main housing of the hydraulic motor assembly of the coiled tubing head shown in FIG. 1.
Figure 20:
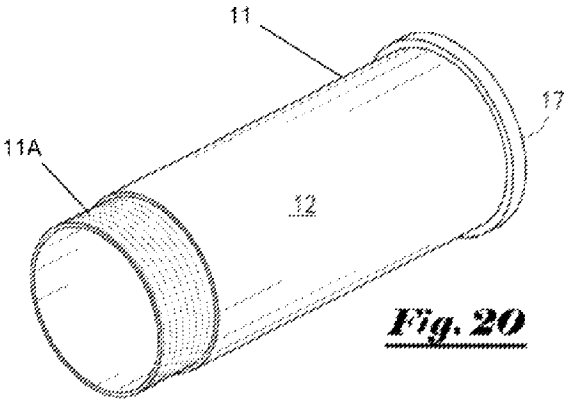
FIG. 20 is a perspective view of the main housing of the hydraulic motor assembly of the coiled tubing head shown in FIG. 1.
Figure 22:
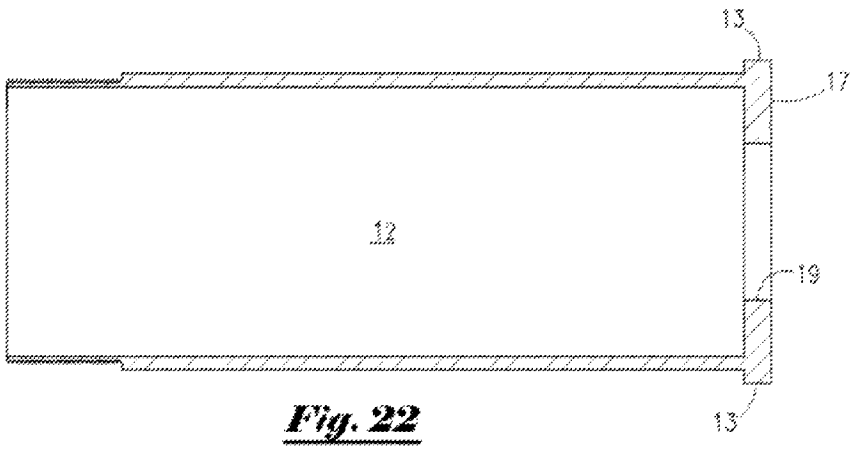
FIG. 22 is a longitudinal cross section view of the main housing of the hydraulic motor assembly of the coiled tubing head shown in FIG. 1.

FIGS. 20-22 show the cylindrical main housing (12). The main housing (12) is comprised of a cylindrical outer surface (11) that is capped at its front end by the cylindrical front housing stop (17) with the bore or rotor opening (19). The housing stop (17) extends around the main housing (12) to create a stop lip (13). Threads (11A) are provided for attachment of the rear main housing cover assembly (70).

Figure 23:
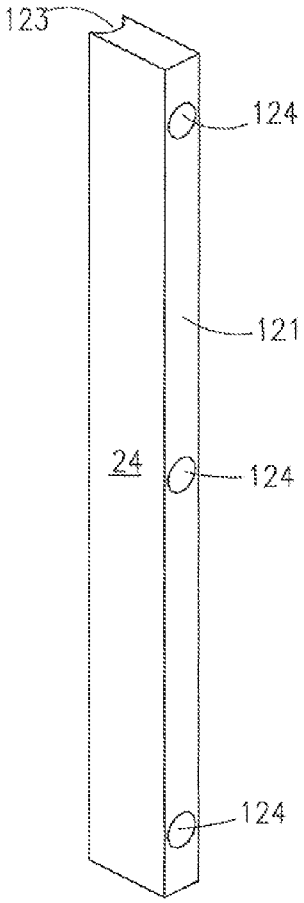
FIG. 23 is a perspective view of the vane for the vane section of the rotor shaft of the hydraulic motor assembly of the coiled tubing head shown in FIG. 1.
Figure 25:
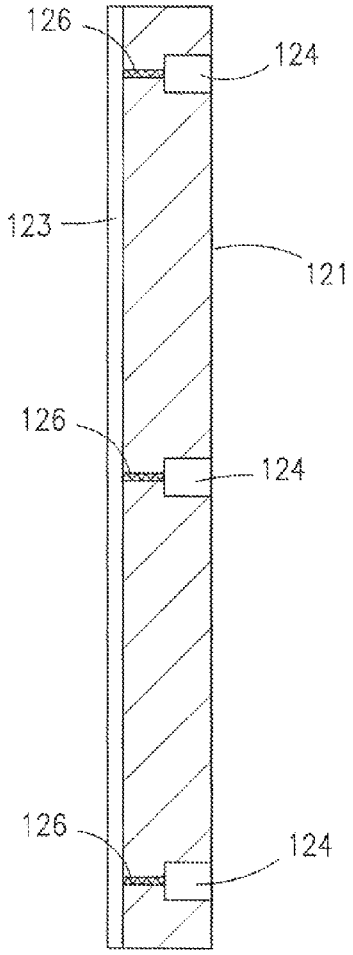
FIG. 25 is a longitudinal cross section view of the vane for the vane section of the rotor shaft of the hydraulic motor assembly of the coiled tubing head shown in FIG. 1.
Figure 24:
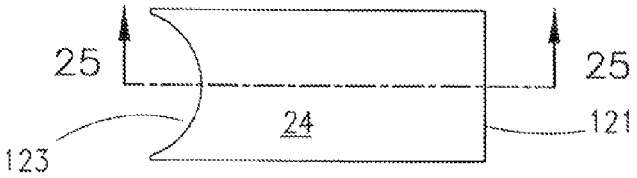
FIG. 24 is a front elevation view of the vane section of the rotor shaft of the hydraulic motor assembly of the coiled tubing head shown in FIG. 1.

A vane (24) for the vane section (22) of the rotor shaft (20) is shown in a FIGS. 23-25. The lower or inward edge (121) of each vane (24) has a plurality of bores (124), each bore (124) having an inserted coiled spring (126). As shown in FIG. 2, when a vane (24) is positioned in a vane space (24A) on the vane section (22) of the motor rotor shaft (20), the spring (126) will move the vane (24) radially outward in the vane spaces (24A) against the interior surface wall (29) of the vane housing (16). The outward end (123) of each vane (24) has a longitudinal groove (127). It is thought that the vanes will be made of a suitable polymer material for ready replacement though other types of material may be utilized.

Figure 28:
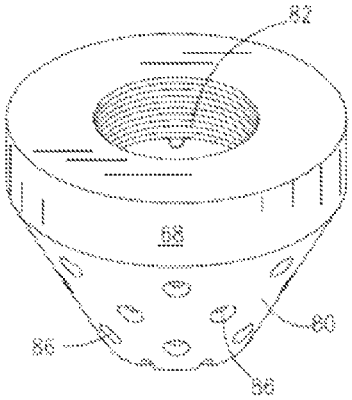
FIG. 28 is a perspective view of the nozzle of the hydraulic motor assembly of the coiled tubing head shown in FIG. 1.
Figure 30:
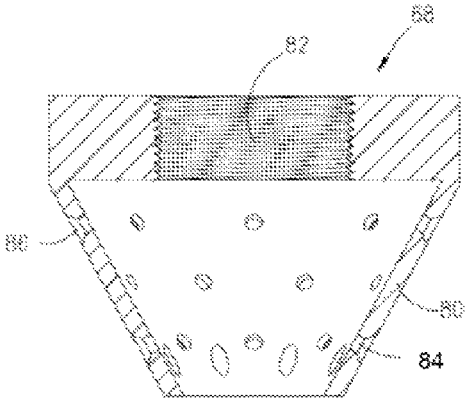
FIG. 30 is a longitudinal cross section view of the nozzle of the hydraulic motor assembly of the coiled tubing head shown in FIG. 1.
Figure 29:
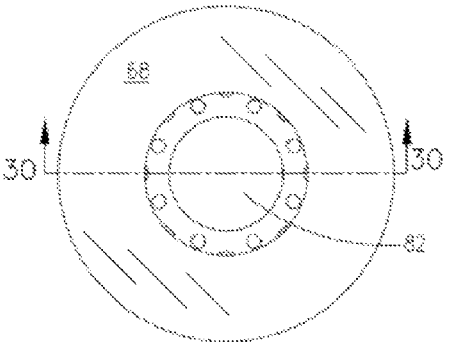
FIG. 29 is a rear elevation view of the nozzle of the hydraulic motor assembly of the coiled tubing head shown in FIG. 1.

FIGS. 28-30 show the nozzle (68). The nozzle (68) is comprised on a conically shaped nosecone (80) having a fluid bore (82). Arranged at desired angles around the periphery of the nosecone (80) are a plurality of nozzle bores (84) each in communication with the fluid bore (82). The nozzle bores (84) create a plurality of nozzle jets (86) directing fluid flow from the hydraulic motor assembly. The fluid bore (82) of the nozzle (68) is configured for attachment to the forward end of the rotor shaft (20) by means of attachment threads or other suitable attachment means.

Figure 26:
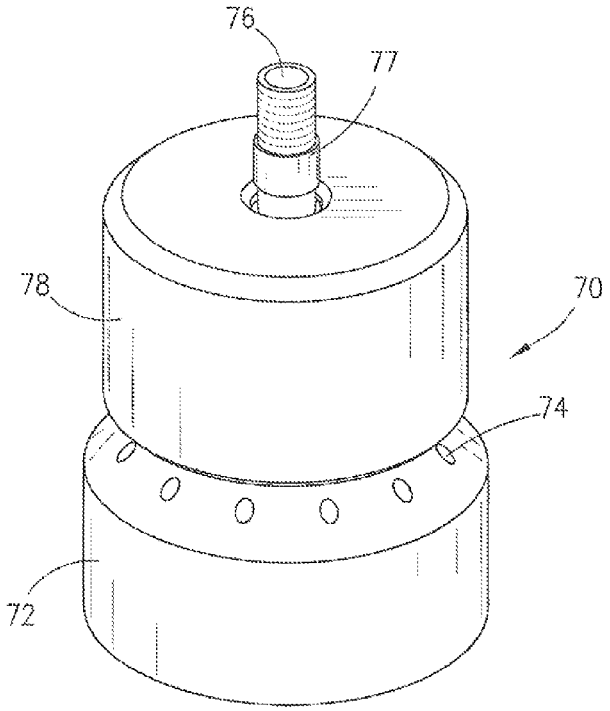
FIG. 26 is a perspective view of the rear main housing cover assembly of the hydraulic motor assembly of the coiled tubing head shown in FIG. 1.
Figure 27:
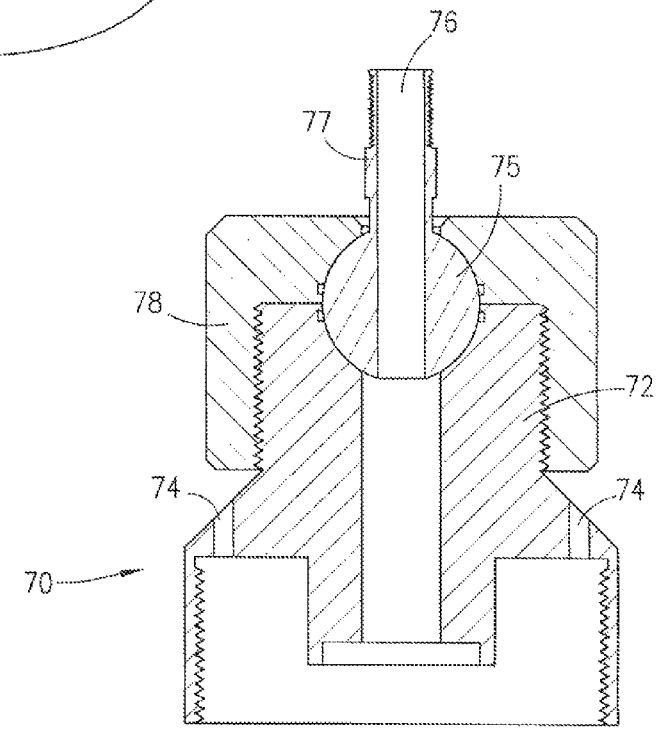
FIG. 27 is as cross section view of the rear main housing cover assembly of the hydraulic motor assembly of the coiled tubing head shown in FIG. 1.

FIGS. 26 and 27 show the rear main housing cover assembly (70). The rear main housing cover assembly (70) has a ported rear cover (72) with a plurality of ports (74) to provide fluid access to the main housing 12. The main housing cover (72) has internal threads for attachment to the main housing (12). A ball (75), having a through bore (76) and a threaded attachment stem (77) for attachment to the coiled tubing string (62), is swivelly mounted to the rear cover (72) by means of the threadably attached rear cover attachment cap (78). The ball (75) and the threadable attachment cap (78) creates a non-rotating ball and socket joint to allow the mud motor assembly to pivot on the coiled tubing string.

Figure 31:
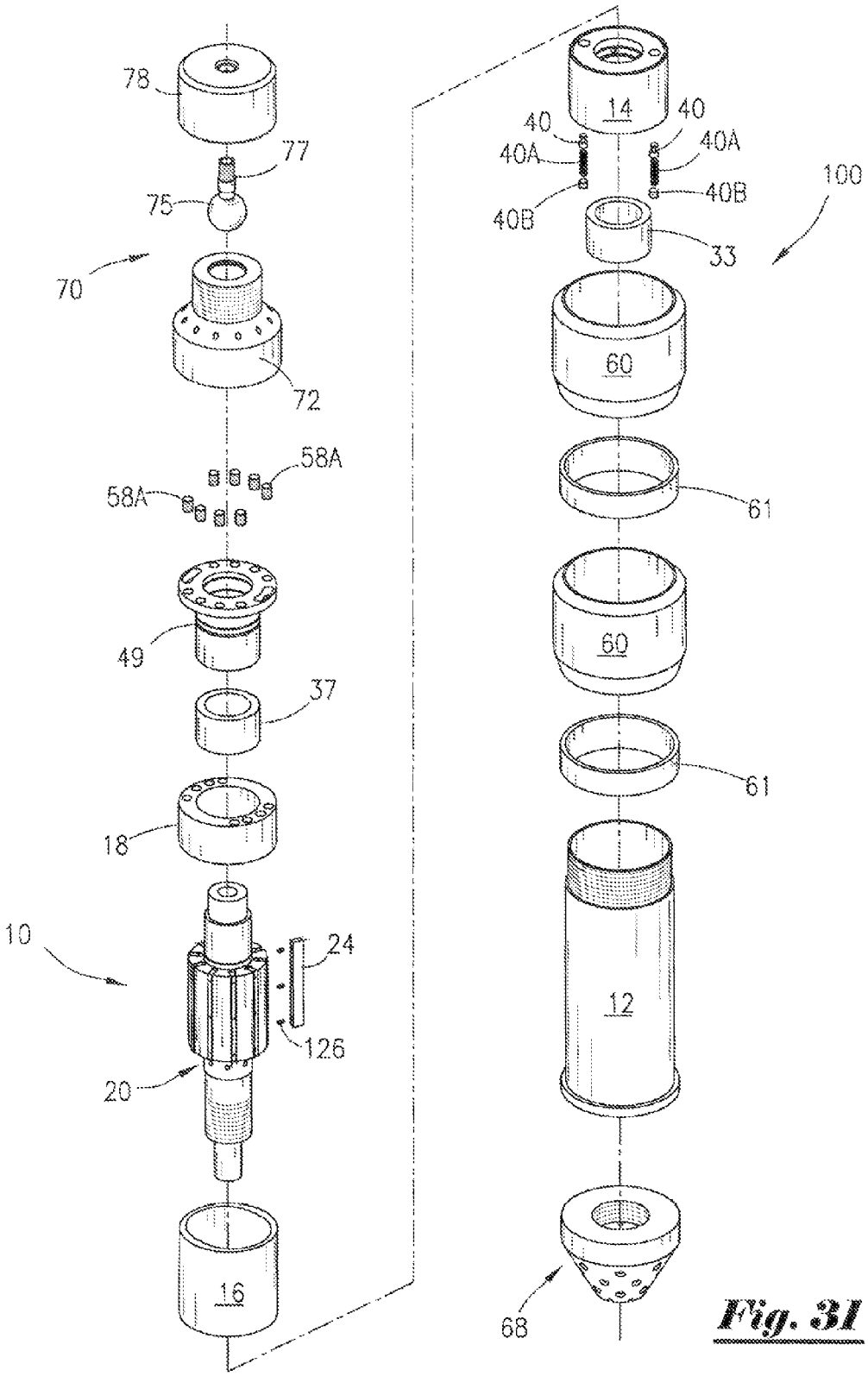
FIG. 31 is an exploded view of the components of the hydraulic motor assembly of the coiled tubing head shown in FIG. 1.

FIG. 31 is an exploded view of the components of the coiled tubing head (100). To assemble the coiled tubing head the hydraulic vane motor assembly (10) is first assembled by inserting the front bearing housing (14), with the desired check valves (40) inserted into check valve bores (39), and the front bearing assembly (33) onto the main motor rotor shaft (20). A vane (24) with vane springs (126) is positioned in each vane space (24A) of the vane section (22) of the motor rotor shaft (20). The vane housing (16) is then positioned over the vane section (22) of the rotor shaft (20) so that the vanes extend radial outward to the interior wall (29) of the vane housing (16). The rear bearing housing (18) and the rear bearing assembly (37) are then positioned on the motor rotor shaft (20) to abut the vane housing (16). Alignment pins with corresponding alignment bores, not shown, or other means suitable means are used to maintain the vane housing (16) in the desired position with respect to the front bearing housing (14) and the bearing housing (14) the rear bearing housing (18).

With the aforesaid components assembled around the motor rotor shaft (20), the assembled components are then inserted into the main housing (12) with the front face (21) of the motor rotor shaft (20) protruding through the rotor opening (19) of the front housing stop (17). The rear stop assembly (49) is then threaded or screwed into the main housing in order to secure the motor rotor shaft (20) with the attached components within the main housing (12).

The rear stop assembly (49) is then backed out or unscrewed until the fluid slots (56) in the rear end (52) of the rear stop assembly (49) correspond with the fluid exit slots (48) of the rear bearing housing (18). Set screws (58A) are placed into the threaded openings (58) to engage the rear bearing housing to maintain the position of the rear stop assembly (49) with respect to the rear bearing housing (18) and to engage the seals (15A) and force the entire assembly against the front housing stop (17) of the main housing (20). The flexible seals (60) separated by seal spacers (61) are then installed onto the main housing (12) against the stop lip (13).

The rear main housing assembly (70) is then screwed onto the main housing (12) to complete the vane motor assembly (10). The nozzle assembly (68) may then be threadably or otherwise attached to the portion of the motor rotor shaft (20) that protrudes through the rotor bore (19) of the front housing stop (17). The coiled tubing head (10) may then be attached to the attachment stem (77) to a coiled tubing string by a release mechanism.

During assembly of the front bearing housing (14) a check valve spring (40A) of a desired spring constant may be selected and inserted with the check valve (40). The selection of the check valve spring will depend upon the anticipated annulus pressures and the desired rate of rotation of the motor rotor shaft (20).

Operation

In operation, the coiled tubing head (100) with the attached seals (60) are inserted via the attached coiled tubing (62) into a flow line (65). The seals (60) serve to seal the annulus (63) between the motor assembly (10) and coiled tubing (62) and the flow line (65) to create a fluid pressure at the rear or high pressure side of the motor assembly (10). When fluid is pumped on the annulus or down the flow line, fluid under pressure in the annulus (63) enters the motor assembly (10) through the ports (74) of the rear cover (72) or the rear main housing cover assembly (70). This fluid flows through the fluid ports (46) of the rear bearing housing (18) to enter the vane housing (16) around the vane section (22) of the motor rotor shaft (20) to fill the vane spaces (24A) around the vanes (24). The fluid introduced into the annulus may be any suitable fluid including a fluid that would help serve to dissolve obstructions in the flow line. A suitable fluid would include crude oil, diesel fuel, solvents or any other fluid used as a clean out for a flow line, pipe line or well bore.

Because the vane housing (16) has a cammed interior surface wall (29), the interior space (27) around the motor rotor shaft (20) is unsymmetrical. Because of the unsymmetrical space (27), fluid in the vane housing (16) flows from the smaller space or volume around the motor rotor shaft (20) to the larger space or volume and this flow or displacement of fluid causes the motor rotor shaft (20) and the attached nozzle (68) to rotate. The ports (39) with the check valves (40) are on the high pressure side of the vane motor assembly (10) and limit the amount of fluid that will travel vane housing (16) through the vane section (22) by diverting a portion of the fluid around the vane section (22) to the bore opening (35) and ultimately to the fluid ports (30) of the motor rotor shaft (20) so as to regulate the rotation speed and torque of the rotor shaft (20) during operation.

As the motor rotor shaft (20) rotates, the nozzle (68) rotates, and the fluid in the vane housing (16) is discharged through the outlet fluid ports (36B) in the front bearing housing (14) to the fluid ports (30) of the motor rotor shaft (20) and ultimately into the fluid bore (82) of the nozzle (68) to be ejected from the nozzle (68) through the nozzle jets (86). Ejected fluid from the rotating nozzle jets (68) will break up and dislodge obstructions and debris in the flow line (65). Fluid carrying the flow line debris is then returned to the surface through the through bore (25) of the rotating motor rotor shaft (20) and through the attached coiled tubing string.

It is thought that the vane housing (16) of the hydraulic vane motor assembly (10) will have a single inlet port (36A) and a single outlet port (36B). The vane housing (16) may also be provided with four ports, comprised of two inlet ports (36A) and two outlet ports (36B), to split the fluid flow through the motor assembly (10) into two separate paths. Utilizing such a four port configuration in the hydraulic vane motor assembly (10) will provide a motor that will operate with twice the torque but with one-half of the rotation speed of a similarly sized two port vane motor assembly.

If a four port configuration is utilized in the vane motor assembly (10), the inlet ports (36A) will be positioned be at opposite sides of the motor rotor shaft (20) to balance bearing loads. A valve may be provided to control which inlet port has the higher pressure, provide for bi-directional rotation of the motor rotor shaft (20) of the motor assembly.

In general applications, the vane motor assembly (10) would be considered a positive displacement motor. In other words rotation or speed of the motor rotor (20) is directly proportional to the volume of fluid that is pumped through the vane motor assembly (10). However, the failure to control the volume of fluid pumped through vane motor assembly will allow the motor rotor (20) to rotate at such a high speed and in a manner that could cause damage or premature wear of the motor components. Because this motor assembly (10) is operated inside a pipe or flow line, the speed and torque of the motor rotor must be set internally. The valve ports (39) and check valves (40) at the high pressure side of the front bearing housing (14) limit the amount of fluid that will travel through the motor vane housing (16) and therefore reduce or increase the rotation speed of the motor rotor (20). The check valves (40) in the valve ports (39) allow the torque and operating pressure of the motor to be set by allowing a large portion of the fluid to by-pass the motor vane housing (16). Regardless of the fluid flow path, all fluid would then pass through the nozzle (68) to facilitate the removal of the blockages.

Figure 32:
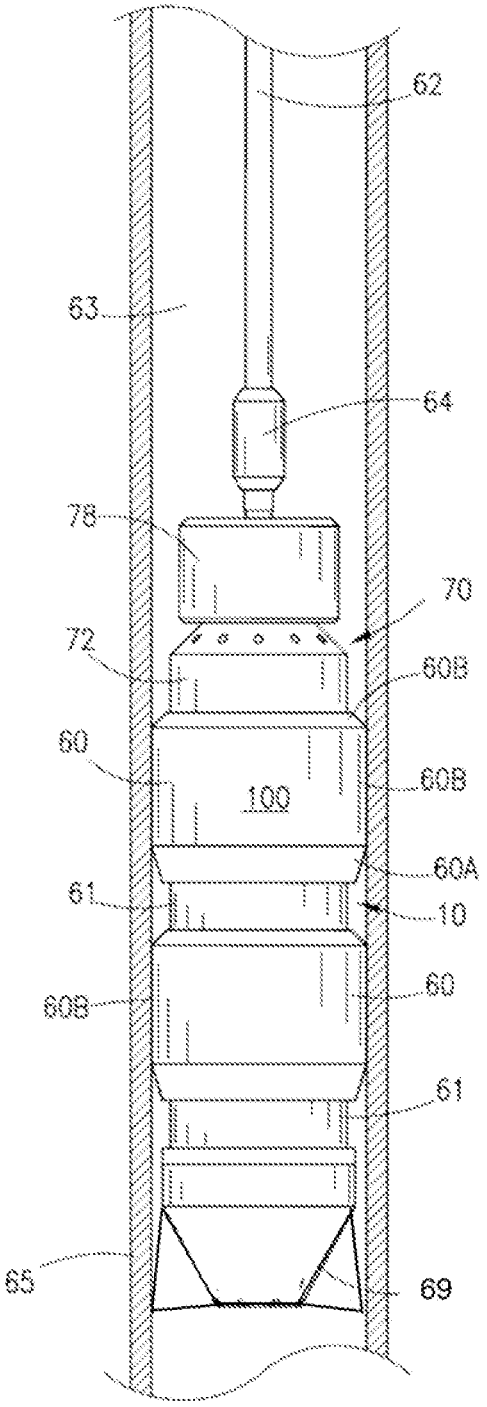
FIG. 32 is a longitudinal cross-section of a flow line with the proposed coiled tubing head attached to a string of coiled tubing, the coiled tubing head having a rotating drill bit.

The nozzle (68) of the vane motor assembly (10) could be replaced with other types of work tools if desired. For instance, a rotating bit (69) could be mounted on the motor rotor shaft (20) in place of the nozzle as shown in FIG. 32. Such a rotating bit (69) may be useful in clearing and removing debris from a flow line or for advancing a well bore. It will be evident that various other changes may be made in the form, construction and arrangement of the parts of the coiled tubing head and hydraulic vane motor assembly without departing from the spirit and scope of the invention or sacrificing its material advantages. It is thought that the coiled tubing head with hydraulic vane motor that is presented herein will be understood from the foregoing description. The form described herein is intended to be merely an example embodiment of the invention.

I claim:

1. A method for removing blockages in a flow line and advancing a tubing string through a flow line comprising the steps of:

(a) providing a flow line;

(b) providing a tubing string;

(c) providing a hydraulic vane motor within an outer motor housing, said hydraulic motor having a hollow rotatable shaft, said hollow rotatable shaft having a plurality of circumferentially distributed longitudinally extending fluid ports, said hollow rotatable shaft providing a return path to said tubing string for removing contaminated fluid from said flow line;

(d) attaching a work tool to said hollow rotatable shaft;

(e) attaching said outer motor housing with said hydraulic vane motor and said attached work tool to said tubing string;

(f) providing at least one flexible seal around said outer motor housing for sealing the annulus between said outer motor housing and said flow line when said outer motor housing with said hydraulic vane motor and said attached work tool is inserted into said flow line;

(g) placing said outer motor housing with said hydraulic vane motor, said flexible seals, said attached work tool, and said attached tubing string into said flow line and thereby sealing said annulus between said outer motor housing and said flow line; and (h) creating fluid pressure in said annulus behind said seals and said hydraulic motor to force fluid through said hydraulic vane motor, and said plurality of fluid ports of said hollow rotating shaft, thereby rotating said shaft and said work tool.

2. The method as recited in claim 1 wherein said step of providing flexible seals sealing said annulus between said flow line and said outer motor housing includes providing flexible cylindrical sleeves around said outer motor housing.

3. The method as recited in claim 2 wherein said flexible cylindrical sleeves are comprised of polyurethane.

4. The method as recited in claim 2 wherein said flow line is a pipeline.

5. The method as recited in claim 2 wherein said flow line is a well bore.

6. The method as recited in claim 2 wherein said tubing includes a coiled tubing string.

7. The method as recited in claim 2 wherein said tubing includes a string of pipe.

8. The method as recited in claim 2 wherein said fluid forced through said hydraulic vane motor for rotating said shaft and said work tool includes crude oil, diesel, or solvents.

9. The method as recited in claim 2 further comprising the step of providing a check valve within said hydraulic vane motor for controlling pressure and fluid flow into said hydraulic vane motor.

10. The method as recited in claim 9 wherein said hydraulic vane motor creates torque at said rotatable shaft.

11. The method as recited in claim 10 wherein said step of providing a check valve includes providing a spring biased check valve, said spring biased check valve selected for creating a desired torque at said rotatable shaft.

12. The method as recited in claim 9 further comprising the step of providing a non-rotating swivel joint attached between said outer motor housing and said tubing string.

13. The method as recited in claim 12 wherein said work tool is a tool for breaking up obstructions in said flow line.

14. The method as recited in claim 13 further comprising the steps of:

(a) breaking up obstructions in said flow line by means of said work tool; and (b) removing obstruction contaminated fluid from said flow line through said hollow rotatable shaft and said tubing string.

15. The method as recited in claim 14 wherein said work tool is a rotating nozzle.

16. The method as recited in claim 14 wherein said work tool is a rotatable bit.

17. In combination with a tubing string inserted into a flow line, an apparatus for removing blockages in a flow line comprising:

(a) a cylindrical outer housing for insertion into a flow line, said cylindrical outer housing having a front end and a rear end;

(b) a cylindrical vane motor housing positioned within said outer housing, said cylindrical vane motor housing having front end and rear end and a cammed interior surface;

(c) a rotatable rotor mounted within said cylindrical vane motor housing, said rotatable rotor having a central through bore and a raised vane section for engagement with said cammed interior surface of said cylindrical vane motor housing, wherein said rotatable rotor has a plurality of circumferentially distributed longitudinally extending fluid ports around said through bore of said rotatable rotor;

(d) inlet and outlet ports for introduction and removal of fluid into and out of said cammed interior surface of said cylindrical vane motor housing for rotating said rotatable rotor in response to said fluid, said outlet ports in communication with said fluid ports of said rotatable rotor;

(e) a resilient seal around said cylindrical outer housing sealing the annulus space between said outer housing and said flow line;

(f) check valves for regulating the fluid pressure in said vane motor housing and thereby rotating said rotor; and (g) a tubing string attached to said outer housing, said tubing string being in communication with said central through bore of said rotatable rotor.

18. The apparatus as recited in claim 17 wherein said rotatable rotor is attached to a rotatable work tool.

19. The apparatus as recited in claim 18 wherein said rotatable work tool includes a nozzle, said nozzle having a plurality jets for providing fluid jets 360° around said flow line.

20. The apparatus as recited in claim 18 wherein said rotatable work tool includes a rotatable bit.

21. The apparatus as recited in claim 18 wherein said tubing string is coiled tubing.

22. A coiled tubing head assembly for use in clearing a flow line, comprising:

(a) flow line;

(b) a coiled tubing string inserted into said flow line;

(c) a motor assembly attached to said coiled tubing string, said motor assembly comprising:

(i) an outer cylindrical housing;

(ii) a cylindrical rotor housing positioned within said outer cylindrical housing, said cylindrical rotor housing having a cammed interior surface;

(iii) a rotatable rotor mounted within said cylindrical rotor housing, said rotatable rotor having a central through bore and a raised vane section, said vane section having a plurality of vanes engaged with said cammed interior surface of said cylindrical rotor housing; and (iv) said outer cylindrical housing having inlet and outlet ports and said cylindrical rotor housing having inlet and outlet ports, said inlet and outlets ports of said outer cylindrical housing and said cylindrical rotor housing being in communication with each other whereby injection of fluid through said inlet and outlet ports into cylindrical rotor housing in response to pressure in said flow line will move said vanes on said vane section and thereby rotate said rotatable rotor;

(d) means for sealing the annulus space between said outer cylindrical housing and said flow line and directing fluid into said inlet and outlets ports of said outer cylindrical housing and said cylindrical rotor housing;

(e) a check valve for controlling the fluid pressure in said cylindrical rotor housing for rotation of said rotatable shaft;

(f) a work tool attached to said rotatable shaft;

(g) wherein said for means for sealing the annulus space between said outer cylindrical housing and said flow line and directing fluid into said inlet and outlets ports of said outer cylindrical housing and said cylindrical rotor housing includes a flexible cylindrical sleeve mounted around said outer cylindrical housing; and (h) wherein said rotatable rotor has a plurality of circumferentially distributed longitudinally extending fluid ports around said through bore of said rotatable rotor, said fluid ports of said rotatable rotor being in communication with said inlet and outlet ports of said cylindrical rotor housing during rotation of said rotor.

23. The apparatus as recited in claim 22 further comprising:

(a) a front bearing housing positioned within said outer cylindrical housing forward of said cylindrical rotor housing for housing a front bearing supporting said rotatable rotor, said front bearing housing having inlet and outlet fluid ports in communication with said fluid ports circumferentially distributed around said through bore of said rotatable rotor, said front bearing housing having a port for housing said check valve, said port for housing said check valve being in communication with said through bore of said rotatable shaft.

24. The apparatus as recited in claim 23 further comprising:

(a) a rear hearing housing positioned within said outer cylindrical housing rearward of said cylindrical rotor housing for housing a rear bearing supporting said rotatable rotor.

25. The apparatus as recited in claim 24 further comprising means for reversing the rotation of said rotatable rotor.

26. The apparatus as recited in claim 23 wherein said check valve is selected to provide a desired rotational speed and torque in said rotatable shaft.

27. The apparatus as recited in claim 23 wherein said work tool is a rotatable bit.

28. The apparatus as recited in claim 23 wherein said work tool is a rotatable nozzle.

29. The apparatus as recited in claim 28 wherein the fluid directed into said inlet and outlets ports of said outer cylindrical housing and said cylindrical rotor housing is delivered to said rotatable nozzle.

30. In the combination of a flow line, a coiled tubing string and a coiled tubing head, an improved coiled tubing head assembly comprising:

(a) a flow line;

(b) a coiled tubing string;

(c) a motor assembly attached to said coiled tubing string, said motor assembly comprising:

(i) a cylindrical housing;

(ii) a rotor housing positioned within said cylindrical housing;

(iii) a rotatable rotor mounted within said rotor housing, said rotatable rotor having a central through bore and a raised vane section, wherein said rotatable rotor has a plurality of circumferentially distributed longitudinally extending fluid ports around said through bore of said rotatable rotor; and (iv) said cylindrical housing having inlet and outlet ports and said rotor housing having inlet and outlet ports, said inlet and outlets ports of said cylindrical housing and said fluid ports of said rotor housing being in communication with each other whereby injection of fluid through said inlet and outlet ports into said rotor housing and into said fluid ports of said rotor in response to pressure in said flow line will move said vanes on said vane section and thereby rotate said rotatable rotor;

(d) at least one flexible seal that seals the annulus space between said cylindrical housing and said flow line; and (e) a check valve for controlling fluid pressure in said rotor housing for rotation of said rotatable shaft.

31. The apparatus as recited in claim 30 further comprising a work tool attached to said rotatable shaft.

32. The apparatus as recited in claim 31 wherein said work tool is a rotatable nozzle.

33. The apparatus as recited in claim 32 wherein the fluid directed into said outer cylindrical housing and into said cylindrical rotor housing is delivered to said rotatable nozzle.

* * * * *